US005586616A

United States Patent [19]

Ksenych

[11] Patent Number: 5,586,616

[45] Date of Patent: Dec. 24, 1996

[54] ROTATABLE SCAFFOLD

[76] Inventor: Nick Ksenych, 1900 14th Ave., NW., P.O. Box 1564, Watertown, S. Dak. 57201

[21] Appl. No.: 336,855

[22] Filed: Nov. 8, 1994

[51] Int. Cl.[6] ..... E04G 1/00

[52] U.S. Cl. ..... 182/222; 182/63; 182/148

[58] Field of Search ..... 182/63, 141, 148, 182/62.5, 129, 222

[56] References Cited

U.S. PATENT DOCUMENTS 668,627 2/1901 Crow .
2,413,909 1/1947 Clement et al. .
2,966,956 1/1961 Campbell et al. .
3,056,465 10/1962 Gerrans ..... 182/148
3,509,965 5/1970 Mitchell .
4,271,926 6/1981 Cullity .
4,936,414 6/1990 Rybke .
5,078,021 1/1992 Freywiss .
5,088,577 2/1992 Pierce .
5,096,018 3/1992 Dickenson, Jr. .

*Primary Examiner*—Alvin C. Chin-Shue
*Attorney, Agent, or Firm*—Saidman DesignLaw Group

[57] ABSTRACT

A scaffold adapted to be used with a forklift truck. The scaffold may be rotated manually 360 degrees by a worker after being lifted by the forklift. The unit is simple in construction, inexpensive, safe and easy to use.

11 Claims, 9 Drawing Sheets

ROTATABLE SCAFFOLD

BACKGROUND OF THE INVENTION

I. Field of the Invention

This invention is related to scaffolds or work platforms and, more particularly, is directed towards a scaffold which may be used in conjunction with a forklift truck.

II. Description of Related Art

The prior art is replete with structures which set forth various schemes for manipulating a work platform or scaffold, some in conjunction with a forklift truck or other prime mover. By and large, these schemes are complex, subject to mechanical and/or electrical breakdowns, and too expensive. Following is a brief discussion of a representative sample of prior art United States patents in this area.

Crow (U.S. Pat. No. 668,627) shows a scaffold in which movement of the platform relative to the base is effected by means of a worm gear "k" which is hand-cranked by the person on the scaffold.

Clement et al. (U.S. Pat. No. 2,413,909) disclose in FIG. 1 a linesman's platform 56 cantilevered from a support tower 27. Platform 56 is rotatable about tower 57 by means of a workman-operated hand-crank and gear 58 coacting with a crowngear 59 to position the platform anywhere in a 360 degree circle.

Campbell et al. (U.S. Pat No. 2,966,956) show a platform 21 which is moved about by means of forks 36 of a forklift truck being inserted into loops 51.

Mitchell (U.S. Pat. No. 3,509,965) provides a platform 16 which is vertically moveable on a multi-sectioned, telescoping mast 14 that is horizontally extendable relative to the mast from a centered position to a cantilevered position (cf. FIGS. 1 and 2) and appears rotatable through 360 degrees by means of a turntable 12 (column 6, lines 31–36).

Cullity (U.S. Pat. No. 4,271,926) provides a work platform 22 rotatable about a boom connection 24 through 180 degrees by means of a pair of hydraulic cylinders 52 and 60.

Rybka, deceased (U.S. Pat. No. 4,936,414) attaches a scaffolding platform 40 to an extendable boom 38 which, in turn, is attached to a turret 22 rotatably mounted on a rigid base 30. Tine-receiving sockets 100 on base 30 permit the assembly to be lifted and moved by a forklift truck 24.

Freywiss (U.S. Pat. No. 5,078,021) shows the use of a worm gear and a toothed gear to effect relative rotary motion between a laterally extending motor 26 and a vertical shaft Pierce (U.S. Pat. No. 5,088,577) discloses a framework attachable to a scaffolding and used to lift and move the scaffolding. Sleeves 12 receive the tines 14 of a forklift truck which lifts and moves the assembly.

Dickenson, Jr. (U.S. Pat. No. 5,096,018) lifts and positions a manbasket by means of a forklift truck.

As noted above, most of the foregoing structures are needlessly complicated, have too many moving parts, are subject to electrical and/or mechanical breakdown, and are simply too expensive to be used on a wide scale. It would therefore be highly desirable if there could be provided a work platform or scaffold which could be used with an ordinary forklift truck, which is rotatable 360 degrees, and which would be inexpensive, easy to use, and reliable in operation. It is towards these ends that the present invention is advanced.

OBJECTS AND SUMMARY OF THE INVENTION

It is therefore a primary object of the present invention to provide a scaffold for use with a forklift truck which is simple, inexpensive, reliable and easy to use.

Another object of the present invention is to provide a scaffold which may be used with a forklift truck and which is fully rotatable 360 degrees during use.

Another object of the present invention is to provide a scaffold useable with a forklift truck which may be manually rotatable by a worker on the platform using a simple hand-crank.

A still further object of the present invention is to provide a simple, inexpensive and reliable scaffold which may be used with a standard forklift truck to reach areas previously relatively inaccessible.

An additional object of the present invention is to provide a rotatable scaffold for use with a forklift truck which is inexpensive, reliable and yet completely safe in operation.

The foregoing and other objects are achieved in accordance with one aspect of the present invention through the provision of a scaffold adapted for use with a forklift truck, the truck normally including a pair of tines for lifting a load. The scaffold comprises a work platform and a vertical mast to which the work platform is mounted. The vertical mast preferably includes means for mounting same to the tines of the forklift truck, and means for allowing a worker on the platform to rotate the platform about the mast to any desired position. The platform is preferably rotatable 360 degrees about the mast. The worker may manually rotate the platform about the mast using, in one preferred embodiment, a gear plate immovably mounted about the periphery of the mast, and a worm gear connected to a hand-crank and coupled to the gear plate whereby the platform rotates about the gear plate when the hand-crank is turned by the worker.

In accordance with other aspects of the present invention, the means for mounting the mast to the tines of the forklift truck preferably comprises a base having horizontal slot means formed therein for receiving the fines of the forklift truck. The slot means preferably comprises a pair of slots, each being tapered to accommodate the tapered tines of the forklift truck.

In accordance with another aspect of the present invention, the mast preferably includes foothold means mounted to the mast and adapted to rotate with the platform to allow the worker to ascend to and descend from the platform. In accordance with other specifics of the present invention, the platform preferably includes a front end, a rear end, a floor extending from the front end to the rear end, a railing connected to the floor, and means for rotatably mounting the rear end to the mast. The latter preferably comprises cup means fastened to the railing and adapted to be placed over the top end of the mast, and cutout means formed in the floor and aligned with the cup means, the cutout means adapted to receive the mast therewithin. The vertical mast also preferably includes a rotatable sleeve mounted at a location between the top of the mast and the floor of the scaffold. The cutout means more particularly preferably includes means for mounting the floor to the rotatable sleeve. The latter more particularly comprises a mounting plate connected to the sleeve, and means for fastening the floor to the mounting plate.

In accordance with yet another aspect of the present invention, there is provided a scaffold which comprises a work platform including a floor and a railing extending from the floor, a vertical mast having a rotatable sleeve to which the floor of the work platform is fixably coupled, and manually operable hand-crank means on the rotatable sleeve permitting a worker on the platform to rotate the platform 360 degrees about the mast. The mast further preferably includes a base having means for adapting same to be mounted to the tines of a forklift truck. The work platform further preferably includes a storage bin for allowing tools or equipment to be stored therein, non-skid mat means on the floor, and means for permitting fluid to drain from the floor.

In accordance with yet another aspect of the present invention, there is provided a scaffold which comprises a work platform including a floor, a vertical mast to which the floor of the work platform is rotatably coupled, and manually operable hand-crank means on the mast for permitting a worker on the platform to rotate the platform about the mast. The mast preferably includes a rotatable sleeve to which the floor of the work platform is fixably mounted so as to rotate therewith. The manually operable hand-crank means preferably comprises a hand-crank and gear means mounted to the rotatable sleeve, and a fixed gear mounted to the mast and coupled to the gear means.

BRIEF DESCRIPTION OF THE DRAWINGS

Various objects, features and attendant advantages of the present invention will be more fully appreciated as the same becomes better understood form the following detailed description of the present invention when considered in connection with the accompanying drawings, in which.

DETAILED DESCRIPTION OF THE PREFERRED EMBODIMENTS

Figure 1:
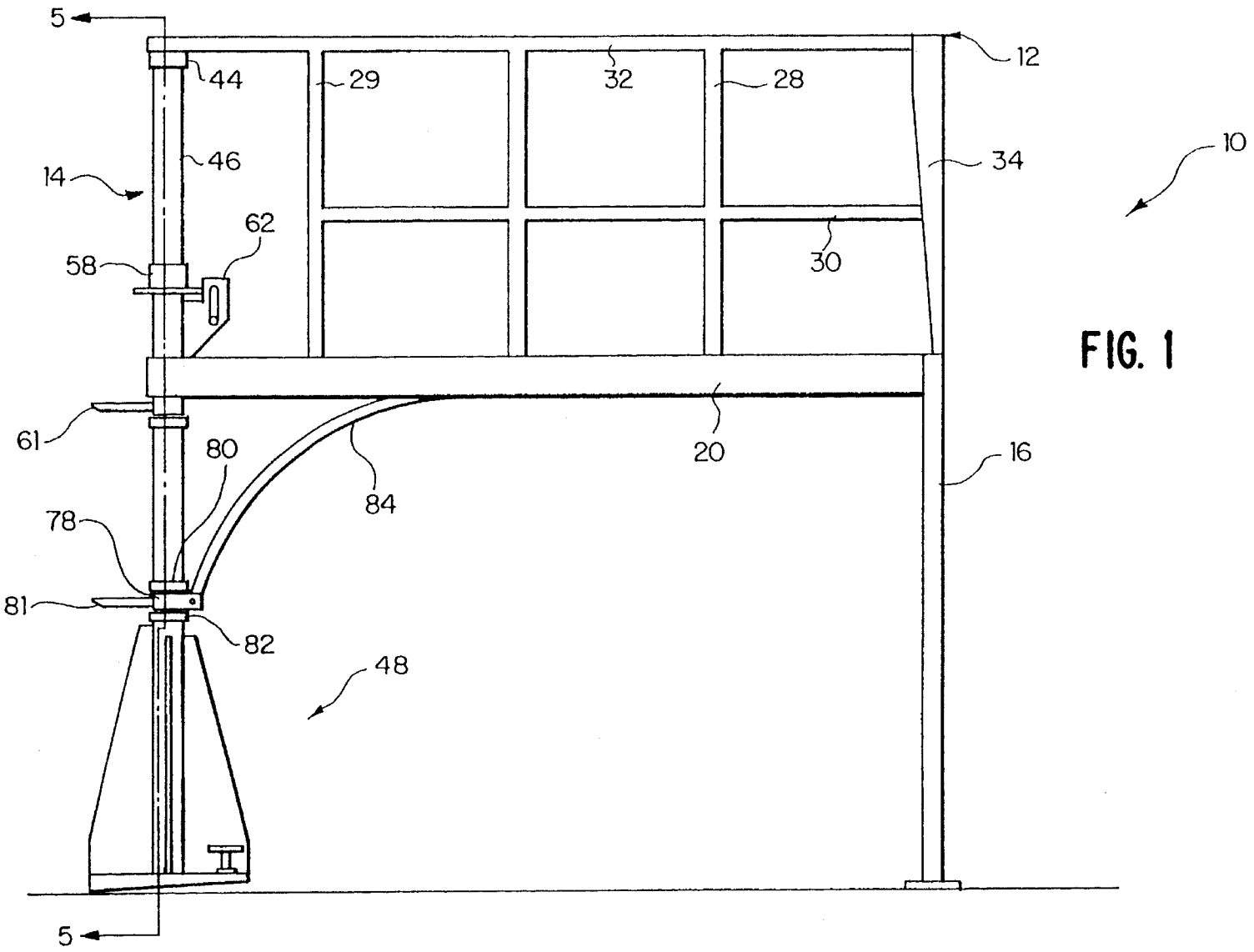
FIG. 1 is a side view in elevation of a preferred embodiment of the present invention shown mounted on the floor.

Referring now to the drawings, wherein like reference numerals represent identical or corresponding parts throughout the several views, and particularly to FIG. 1 thereof, the rotatable scaffold of the present invention is indicated generally by reference numeral 10. Scaffold 10 comprises a work platform 12 and a main mast 14.

In the position illustrated in FIG. 1, rotatable scaffold 10 is shown in its unused or floor mount position and is provided therefore with a pair of auxiliary removable support posts 16 which are, during normal use, separated from work platform 12, as will become more clear hereinafter.

Figure 9:
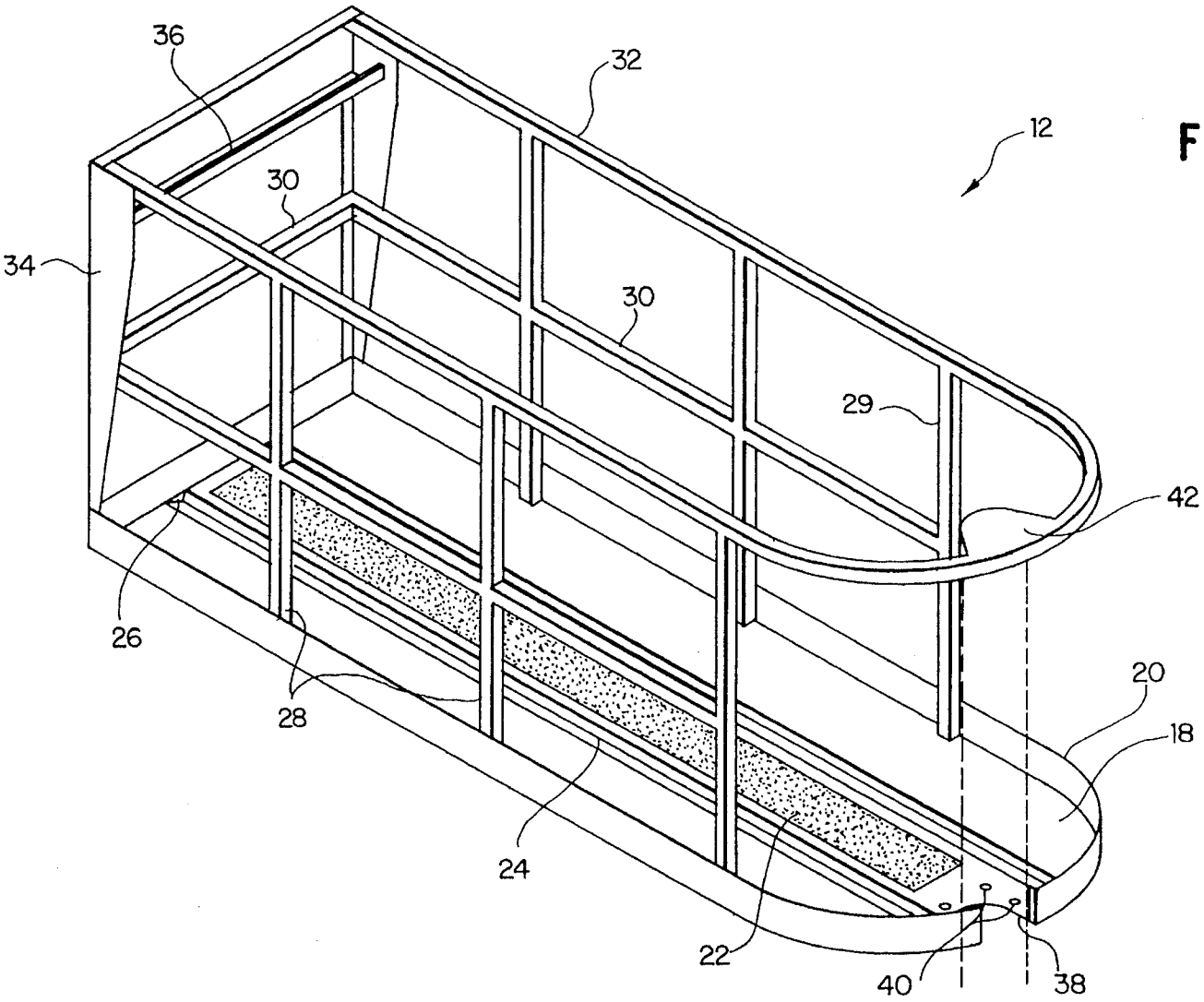
FIG. 9 is a perspective view illustrating a preferred embodiment of the work platform in accordance with the present invention.

Referring now to FIGS. 1 and 9, work platform 12 is seen to comprise a U-shaped floor 18 and a raised edge 20 extending about the periphery of floor 18. Extending longitudinally down the center of floor 18 is a non-skid surface or mat 22 to assist the worker in maintaining his or her footing within platform 12.

On both sides of non-skid surface 22 are a pair of V-shaped channels 24 for guiding any liquid that may be gathered on floor 18 through exit holes 26 located fore and aft.

Extending upwardly from floor 18 and edge 20 are vertical braces 28 located along both sides of floor 18. Midway up braces 28 is a horizontal intermediate rail 30 which extends rearwardly only to vertical brace 29. Also provided is an upper rail 32 which is substantially U-shaped and which parallels the external peripheral shape of floor 18.

Extending upwardly from the front corners of floor 18 are a pair of corner support flanges 34 between which laterally extends a portion of intermediate rail 30. Extending between the top portion of support flanges 34 is a tray 36 or the like for homing tools, equipment, etc., for a worker on platform 12.

At the rear of work platform 12 on floor 18 is located a U-shaped or cylindrical cutout 38 about which are positioned bolt holes 40, for a purpose to be described in greater detail hereinafter.

Aligned with cutout 38 and mounted at the rear of top rail 32 is a plate 42 that supports a pivot cup 44 thereunder. Cutout 38 and pivot cup 44 serve as means for mounting work platform 12 to the main mast 14, as will be described in greater detail hereinafter.

Figure 5:
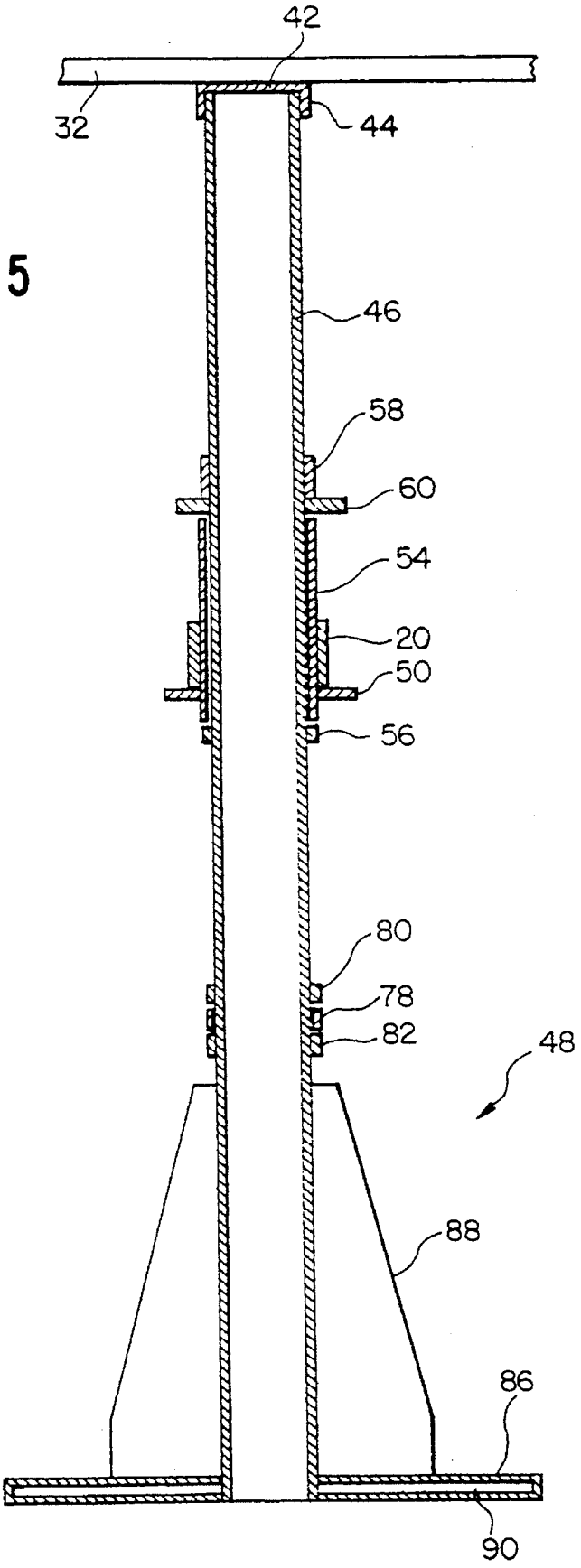
FIG. 5 is a vertical sectional view taken along line 5—5 of FIG. 1.

Referring back to FIG. 1, and also to a vertical sectional view of mast 14 in FIG. 5, it may be appreciated that main mast 14 in this preferred embodiment comprises an immobile center post 46 which extends all the way from pivot cup 44 downwardly to a base member indicated generally by reference numeral 48.

Figure 2:
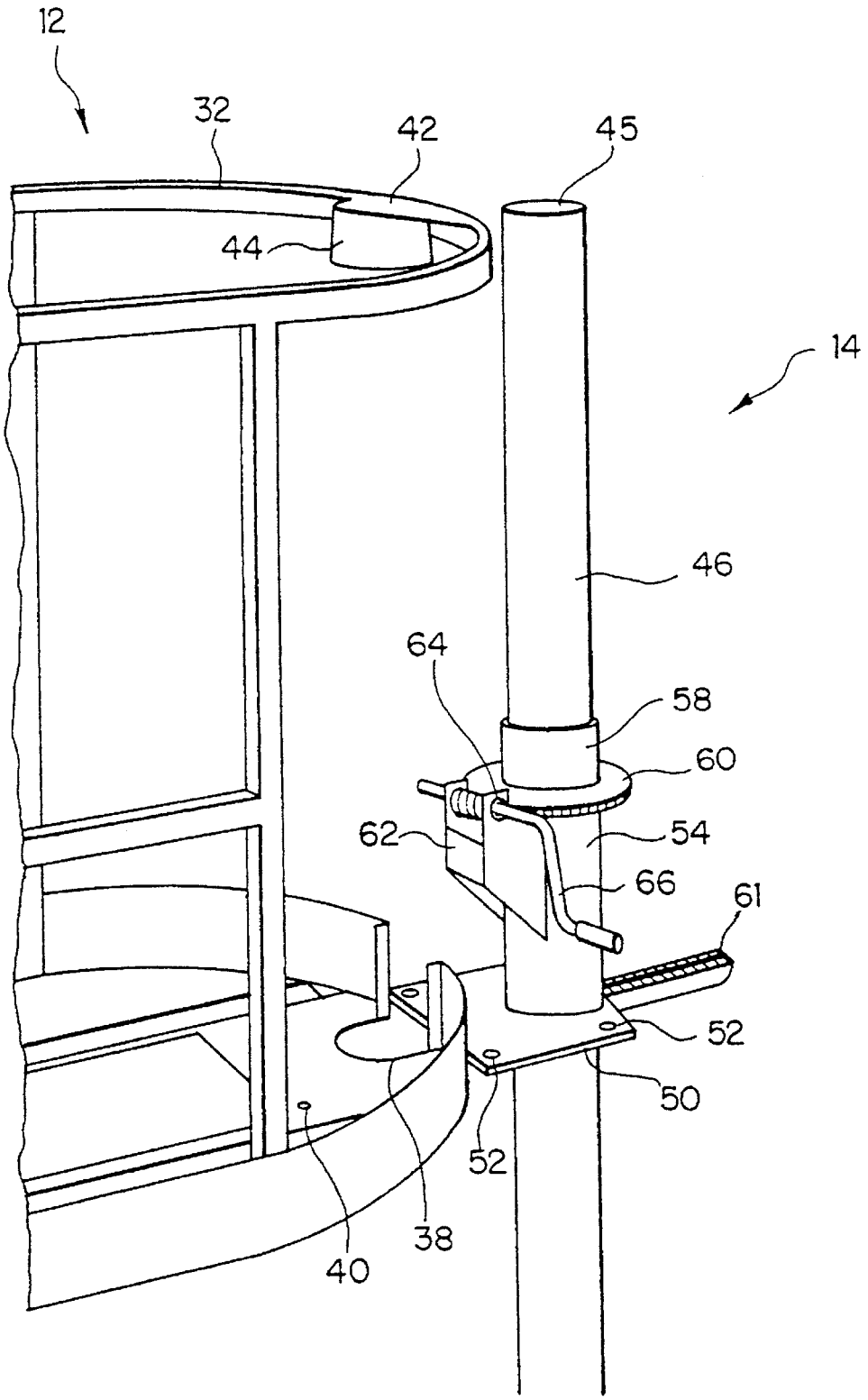
FIG. 2 is an enlarged, perspective, broken away view showing the work platform just prior to its coupling to the main mast.

As seen better in FIG. 2, work platform 12 is adapted to be mounted to center post 46 at two locations: (1) pivot cup 44 is placed over the top 45 of post 46 and is free to pivot thereabout; and (2) cutout 38 in floor 18 is placed about post 46, as will be described in greater detail below.

Still with reference to FIGS. 2 and 5, a rotatable sleeve 54 is mounted about post 46 adjacent platform 12. Sleeve 54 is held in place vertically on post 46 by a lower fixed bushing 56 and an upper fixed bushing 58, both of which may be for example welded to post 46.

A mounting plate 50 is attached to the bottom of rotatable sleeve 54 at a location corresponding to the desired height of the floor of work platform 12. Mounting plate 50 includes a plurality of bolt holes 52 that are aligned with bolt holes 40 formed in floor 18. It may be appreciated that plate 50 is adapted to be rotated with rotatable sleeve 54 and, hence, with work platform 12.

Extending rearwardly from rotatable sleeve 54, just adjacent to plate 50, is preferably a foothold or bar 61 which also is adapted to rotate with sleeve 54.

Extending radially from fixed upper bushing 58 is a ring gear 60 which is also fixed to post 46, for a purpose to be described in greater detail hereinafter.

Figure 3:
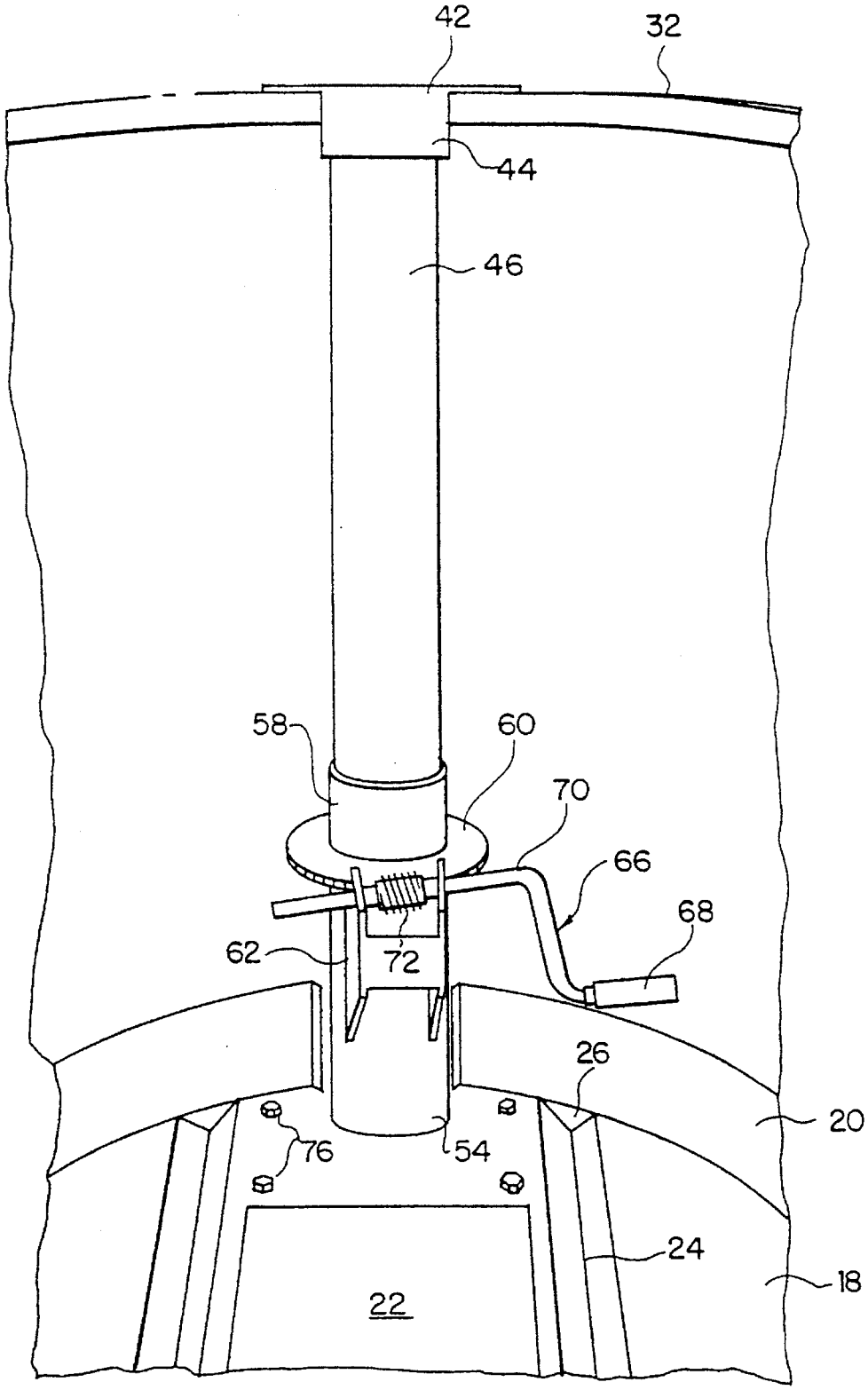
FIG. 3 is a perspective view of the work platform just after its coupling to the main mast.
Figure 6:
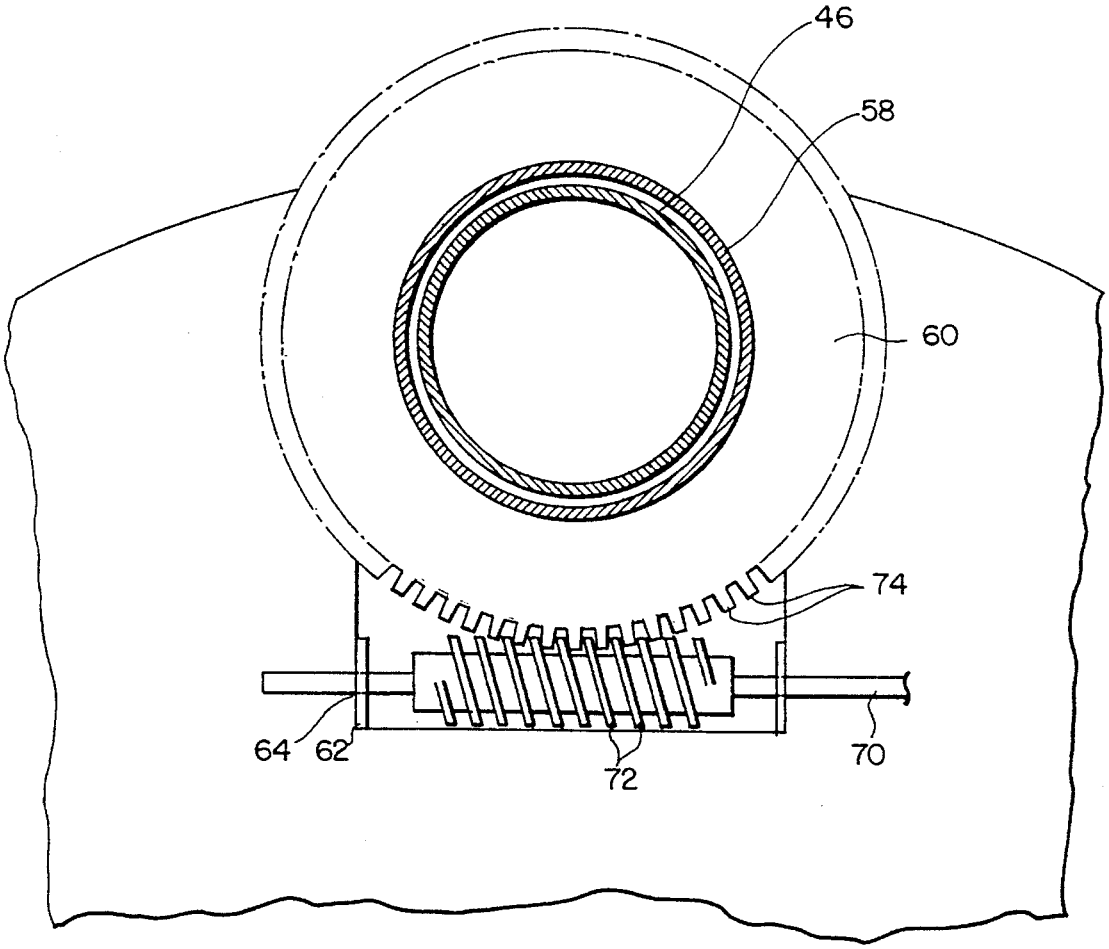
FIG. 6 is an enlarged, cross-sectional view taken along line 6—6 of FIG. 4.

Referring now to FIGS. 2, 3 and 6, rotatable sleeve 54 is seen to more particularly include a support bracket indicated generally by reference numeral 62. Bracket 62 includes side flanges having apertures 64 formed therein. A hand-crank 66 includes a handle 68 and a shaft 70 which extends through apertures 64 of bracket 62. A worm gear 72 is formed on shaft 70 and engages the teeth 74 formed on the periphery of ring gear 60. In this manner, rotation of hand-crank 66 will rotate the sleeve 54 and, hence, work platform 12 360 degrees in either direction about the fixed ring gear 60. The rotation of platform 12 is totally within the control of the operator by means of a simple, reliable and inexpensive manual mechanism.

Reference numeral 76 refers to bolts provided to secure plate 50 (not seen in FIG. 3) to the underside of floor 18 of work platform 12.

Referring back to FIG. 1, positioned just above base member 48 and located about post 46 is a second rotatable sleeve 78 which is held in place on post 46 by an upper fixed bushing 80 and a lower fixed bushing 82. A second foothold or bar 81 preferably extends from sleeve 78 so as to rotate therewith and stay in substantial alignment with foothold 61. Bracing 84 is preferably provided from sleeve 78 to the underside of work platform 12, and therefore rotates with same.

Figure 7:
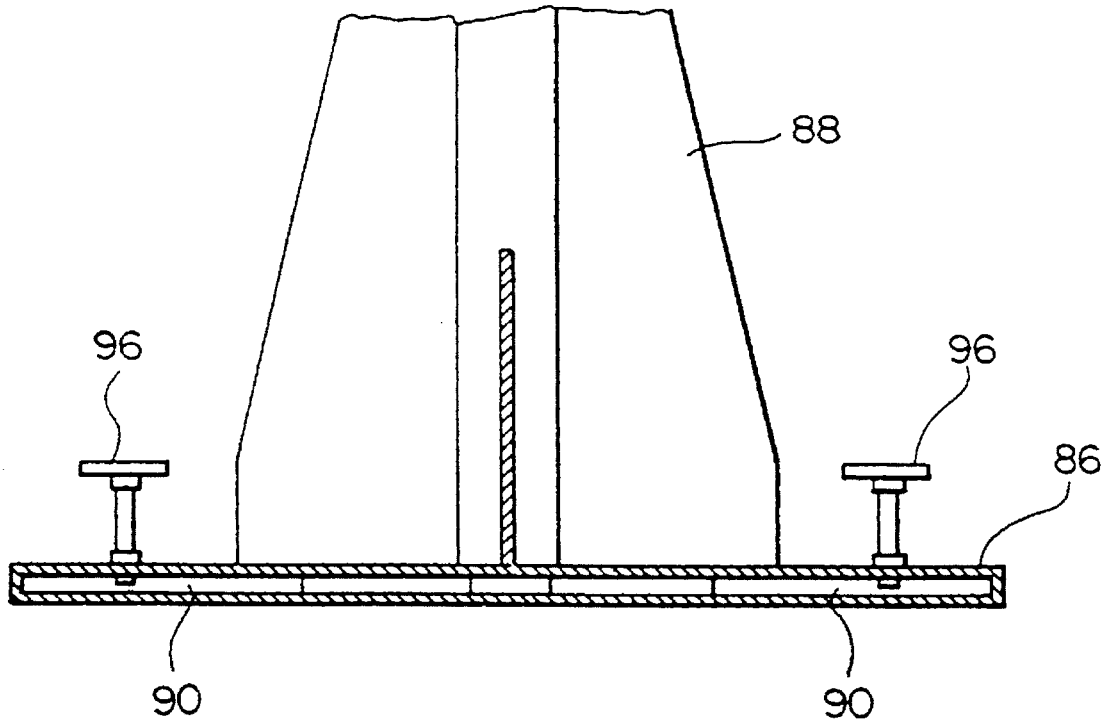
FIG. 7 is an enlarged, sectional view taken along line 7—7 of FIG. 4.
Figure 8:
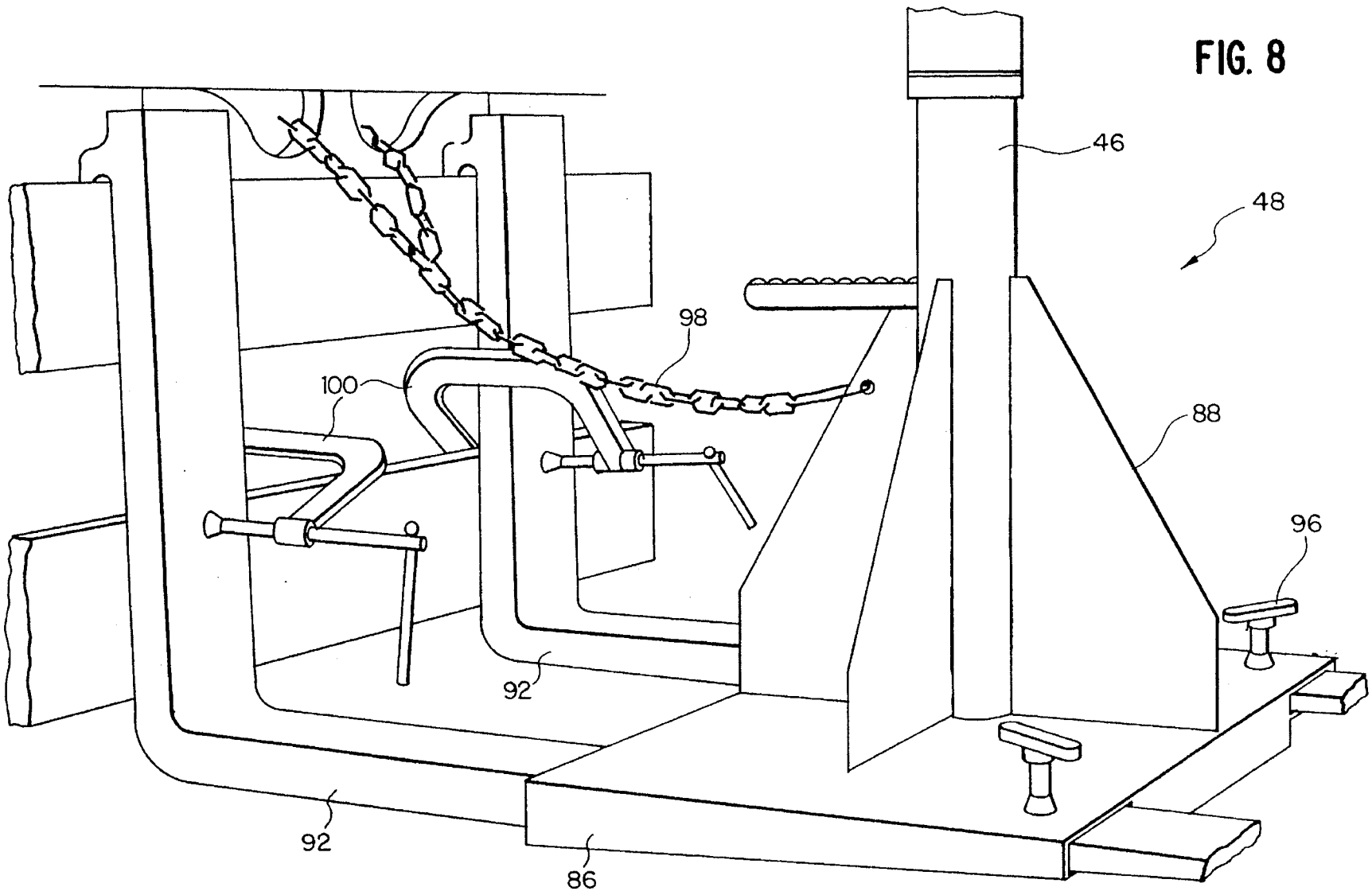
FIG. 8 is an enlarged, perspective broken away view showing one embodiment of how the base of the mast is coupled to the forklift truck.

Referring now to FIG. 8, base member 48 preferably comprises a base 86 on which post 46 is mounted and held in place by radial support flanges 88 located about the periphery thereof. Base 86 includes longitudinal openings 90 (see FIG. 7) in the form of tapered pockets which are adapted to snugly receive the fines 92 of a forklift truck 94. A pair of set screws 96 are preferably provided that extend through base 86 to openings 90 so as to enable adjustment for various sizes of fines and so as to lock base 48 in place on tines 92. Also illustrated in FIG. 8 are safety chains 98 which couple base 48 to forklift truck 94, as well as a pair of C-clamps 100 to limit movement of the tines 92.

Figure 4:
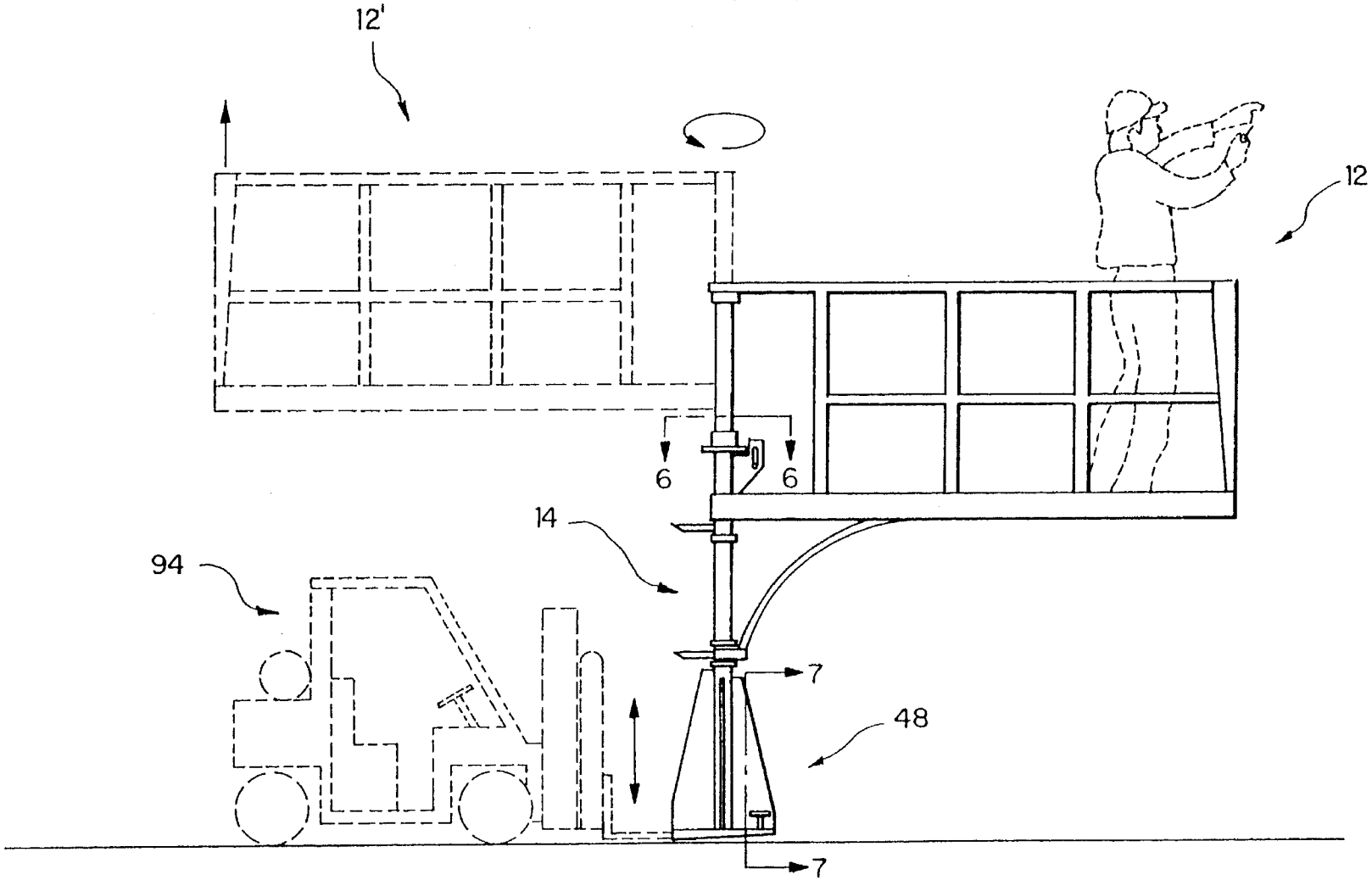
FIG. 4 is a side, schematic view illustrating the operation of the present invention in conjunction with a forklift truck.

In operation, the rotatable scaffold of the present invention may be stored indefinitely as illustrated in FIG. 1 by means of auxiliary support posts 16 located at the forward comers thereof. When it is desired to place scaffold 10 in operation, the fines 92 of a forklift truck 94 are inserted into and secured within base member 48 as shown in FIG. 8. Then, referring to FIG. 4, work platform 12 may be raised by the forklift truck 94 to any desired height (within the limits of the truck), and the work platform 12 may be rotated by the worker 360 degrees about mast 14 so as to enable the worker to reach any desired area, even one which extends over the rear of forklift truck 94 as indicated by the dotted lines and reference numeral 12'.

It is seen by virtue of the foregoing that I have provided an inexpensive, simple, safe and easy to use scaffold for a forklift truck which may be easily rotated 360 degrees to reach heretofore very inaccessible locations. The unit is simple to construct, reliable and needs little maintenance. It may conveniently be broken down into five components for shipping (work platform 12, main mast 14, two support posts 16, and bracing 84) and may be easily assembled in about 10 minutes. Further, the shipping package is compact (28" high, 84" long and 36" wide) and easy to handle.

Obviously, numerous modifications and variations of the present invention are possible in light of the above teachings. It is therefore to be understood that within the scope of the appended claims the invention may be practiced otherwise than as specifically described herein.

I claim as my invention:

1. A scaffold adapted for use with a forklift truck, said truck including a pair of fines for lifting a load, said scaffold comprising:

(a) a work platform; and (b) a vertical mast to which said work platform is mounted, said vertical mast including:

(i) means for mounting said mast to said fines of said forklift truck;

(ii) means for allowing a worker on said platform to rotate said platform about said mast to any desired position; and (iii) foothold means mounted to said mast and adapted to rotate with said platform so as to allow said worker to ascend and descend from said platform.

2. A scaffold as set forth in claim 1, wherein said platform may be rotated 360 degrees about said mast.

3. A scaffold as set forth in claim 1, wherein said means for allowing a worker on said platform to rotate said platform about said mast comprises means mounted on said vertical mast to permit manual rotation of said platform about said mast by said worker.

4. A scaffold as set forth in claim 3, wherein said means mounted on said vertical mast comprises a gear plate immovably mounted about the periphery of said mast, and a worm gear connected to a hand-crank and coupled to said gear plate whereby said platform rotates about said gear plate when said hand-crank is turned by said worker.

5. A scaffold as set forth in claim 1, wherein said means for mounting said mast to said tines of said forklift truck comprises a base having horizontal slot means formed therein for receiving said tines of said forklift truck.

6. A scaffold as set forth in claim 5, wherein said slot means comprises a pair of slots, each of said slots being tapered to accommodate tapered tines of said forklift truck.

7. A scaffold as set forth in claim 1, wherein said vertical mast includes a rotatable sleeve mounted adjacent said platform and including means for coupling said sleeve to said platform and hand-crank means for allowing a worker to manually rotate said platform about said mast.

8. A scaffold adapted for with a forklift truck, said truck including a pair of tines for lifting a load, said scaffold comprising:

(a) a work platform, said platform comprising a front end, a rear end, a floor extending from said front end to said rear end, and a railing connected to said floor; and (b) a vertical mast to which said work platform is mounted, said vertical mast including:

(i) means for mounting said mast to said tines of said forklift truck; and (ii) means for allowing a worker on said platform to rotate said platform about said mast to any desired position; and means for rotatably mounting said rear end to said mast comprising cup means fastened to said railing and adapted to be placed over the top end of said mast, and cutout means formed in said floor and aligned with said cup means, said cutout means adapted to receive said mast therewithin; wherein said vertical mast further includes a rotatable sleeve mounted at a location between said top of said mast and said floor of said platform.

9. A scaffold as set forth in claim 8, wherein said cutout means includes means for mounting said floor to said rotatable sleeve.

10. A scaffold as set forth in claim 9, wherein said means for mounting said floor to said rotatable sleeve comprises a mounting plate connected to said sleeve, and means for fastening said floor to said mounting plate.

11. A scaffold as set forth in claim 10, wherein said means for allowing a worker on said platform to rotate said platform about said mast to any desired position includes a hand-crank and gear means mounted to said rotatable sleeve, and a fixed gear mounted to said mast and coupled to said gear means.

* * * * *